US008480013B2

(12) United States Patent
Causby et al.

(10) Patent No.: US 8,480,013 B2
(45) Date of Patent: Jul. 9, 2013

(54) SPRAY DEVICE

(75) Inventors: Lyall Causby, Tennyson (AU); David Bevan Creed, Kingswood (AU); Robert Sigston, Macclesfield (AU)

(73) Assignee: Antelco Pty. Ltd., Murray Bridge (AU)

( * ) Notice: Subject to any disclaimer, the term of this patent is extended or adjusted under 35 U.S.C. 154(b) by 382 days.

(21) Appl. No.: 12/307,245

(22) PCT Filed: Jul. 6, 2007

(86) PCT No.: PCT/AU2007/000937

§ 371 (c)(1),
(2), (4) Date: Apr. 15, 2009

(87) PCT Pub. No.: WO2008/003143

PCT Pub. Date: Jan. 10, 2008

(65) Prior Publication Data

US 2009/0314859 A1 Dec. 24, 2009

(30) Foreign Application Priority Data

Jul. 7, 2006 (AU) ..... 2006903665

(51) Int. Cl.
*B05B 1/26* (2006.01)

(52) U.S. Cl.
USPC ..... 239/518; 189/37; 189/41; 239/504; 239/522; 239/523

(58) Field of Classification Search
USPC ..... 169/37, 41; 239/499, 500, 504, 518, 239/521–524
See application file for complete search history.

(56) References Cited

U.S. PATENT DOCUMENTS 2,639,947 A * 5/1953 Tramm et al. ..... 239/500
3,061,204 A * 10/1962 MacInnes et al. ..... 239/500

(Continued)

FOREIGN PATENT DOCUMENTS

DE 9012772 U1 10/1991
DE 4406707 A1 9/1995

(Continued)

OTHER PUBLICATIONS

European Search Report, mailed Jul. 9, 2009, for European application No. 07719169.0, 6 pages.

(Continued)

*Primary Examiner* — Jason Boeckmann
(74) *Attorney, Agent, or Firm* — Haynes Beffel & Wolfeld LLP

(57) ABSTRACT

The invention provides an improved miniature spray device (100) for providing uniform water distribution over a designated area surrounding the device (100). The spray device (100) comprises a spray plate (130) which is provided with a water dispersion surface (131) which is preferably cone shaped, a water outlet (120) for directing a stream of water from a pressurized source towards a central region of the spray plate (130), a support frame (150) for holding the spray plate (130) in spaced apart relation to and in alignment with the water outlet (120), wherein the water dispersion surface (131) is provided with flow deflection means (132, 133, 134) for changing the direction of flow of the water as it flows over the surface (131) to produce a substantially uniformly distributed spray pattern.

16 Claims, 3 Drawing Sheets

U.S. PATENT DOCUMENTS

| | | | | |
|---|---|---|---|---|
| 3,918,645 | A | 11/1975 | Mohler et al. | |
| 4,391,410 | A | 7/1983 | Smith | |
| 4,403,661 | A | 9/1983 | Tokar | |
| 4,625,915 | A | 12/1986 | Cockman | |
| 4,728,040 | A * | 3/1988 | Healy et al. | 239/390 |
| 4,735,361 | A | 4/1988 | Wallace | |
| 4,783,007 | A | 11/1988 | Schafer et al. | |
| 5,335,859 | A | 8/1994 | Thayer et al. | |
| 6,276,460 | B1 | 8/2001 | Pahila | |
| 6,976,543 | B1 * | 12/2005 | Fischer | 169/37 |
| 2006/0060361 | A1 * | 3/2006 | Pounder et al. | 169/37 |
| 2006/0113092 | A1 | 6/2006 | Rogers et al. | |

FOREIGN PATENT DOCUMENTS

| | | | |
|---|---|---|---|
| DE | 19654481 | A1 | 7/1998 |
| GB | 2116456 | A | 9/1983 |
| RU | 2173584 | C1 | 9/2001 |
| RU | 2237523 | C1 | 10/2004 |
| SU | 1045867 | A | 10/1983 |

OTHER PUBLICATIONS

International Search Report, mailed Aug. 10, 2007, for International application No. PCT/AU2007/000937, 3 pages.

* cited by examiner

SPRAY DEVICE

FIELD OF THE INVENTION

The present invention relates to a spray device for spraying a liquid. In a particular form the present invention relates to a miniature watering device for providing an evenly distributed spray over a designated area.

BACKGROUND OF THE INVENTION

Often it is a requirement that a spray device provides a substantially evenly distributed spray over a designated area. One such example is a spray device employed to distribute water in a garden or the like. One particular application where this is important, is the use of mini-spray devices which are typically directly tapped or inserted into an irrigation hose and provide a spray pattern about the mini-spray device.

One such example of a prior art spray device is shown in FIG. 1, which depicts a spray device 10 having a water outlet 20 that includes a nozzle 21 that directs a jet or stream of water upwardly to the central region 31 of a spray head 30 mounted underneath cross member 60 which in turn is supported by a pair of opposed frame members 50. As the stream of water makes contact with the central region 31 of spray head 30, it is directed outwards by a plurality of radial channels 32 towards the serrated periphery 31 of the spray head to spray an area located circumferentially about the spray device 10.

A common drawback of these and other similar types of spray devices is that the water is not uniformly or evenly distributed about the area surrounding the spray device. Typically, the area covered or the spray pattern of the spray device will be ring or donut shaped with areas closer to the spray device receiving little or no water. Even within the donut shaped area that receives an adequate amount of water, the spray will often not be evenly distributed. Clearly, this leads to the obvious disadvantage that plants located in areas near to the spray device will not receive adequate watering and suffer as a result. It is also common practice to utilise miniature spray devices to water individual plants or trees with the emitter device located adjacent the trunk of the plant or tree. In this application, the area around the trunk is not watered evenly with only a small percentage of the roots receiving water.

It is an object of the present invention to provide a spray device capable of providing an evenly distributed spray over a designated area.

SUMMARY OF THE INVENTION

According to a first aspect of the present invention, a spray device for spraying water over a designated area, includes:

- a spray plate having a central water impinging region and a water dispersion surface extending away from said central region;
- a liquid outlet to direct a stream of water from a pressurised source towards the central region of the spray plate; and
- a support frame to maintain the spray head in spaced apart relation to and in alignment with the liquid outlet; characterized in that the water dispersion surface includes flow deflection means to change the direction of flow of the liquid as it flows over the water dispersion surface to produce a substantially uniformly distributed spray pattern over the designated area surrounding or partly surrounding the spray device.

The flow deflection means is designed to break up and disturb the flow of the liquid as it flows over the surface of the spray plate, resulting in a spray which is more evenly distributed about the spray device.

Preferably, the water impinging region and water dispersion surface are defined by a downwardly facing recessed portion formed centrally in the spray plate and which is substantially cone-shaped. Other shapes, however, can be utilized depending on what perimeter shape of watering area is required.

Preferably, the spray plate is supported directly above the liquid outlet by the support frame.

Preferably, the flow deflection means comprises a plurality of depressions or dimples formed in the water dispersion surface.

Preferably, the plurality of depressions or dimples are of varying size and/or depth.

Preferably, the plurality of depressions or dimples are located radially about the central vertical axis of the spray plate.

Preferably, the depressions or dimples are formed in circular rows with the depressions in one row being staggered with respect to the depressions in an adjacent row.

Preferably, the depressions or dimples in a respective said row are equally spaced.

Preferably, each depression or dimple in one row overlaps a pair of adjacent depressions in an adjacent row, in both axial and circumferential directions.

Preferably, the recessed portion of the spray plate includes a vertex region which can be flattened, radiused or rounded.

In yet another embodiment, the spray plate is convexly shaped, with the dimples being formed in the outer circumferential surface thereof.

In yet another embodiment, the spray plate is flat, with the dimples being formed on the surface thereof.

In yet another embodiment, the spray plate with dimples may incorporate a serrated periphery located circumferentially about the spray plate.

In yet another embodiment, the spray plate with dimples may incorporate a row or rows of protrusions located radially about the spray plate.

BRIEF DESCRIPTION OF THE DRAWINGS

An illustrative embodiment of the present invention will be discussed with reference to the accompanying drawings wherein.

Figure 4:
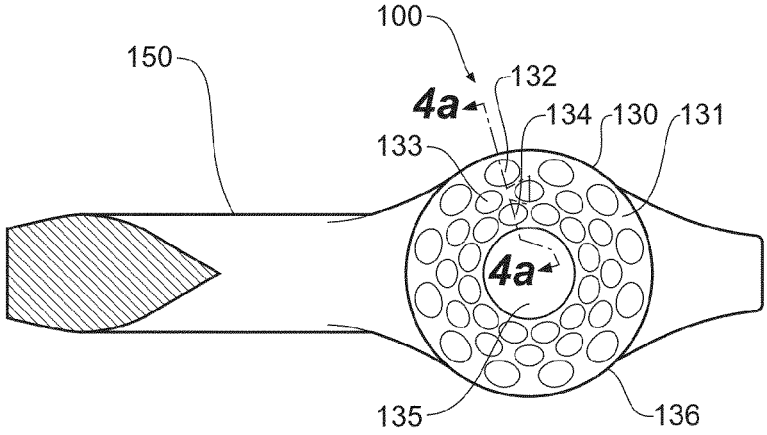
FIG. 4 is a bottom sectional view of the spray device illustrated in FIG. 1 through section 4-4.

FIG. **4*a* is sectional view along line 4*a*-4*a* of FIG. 4**; and

Figure 5:
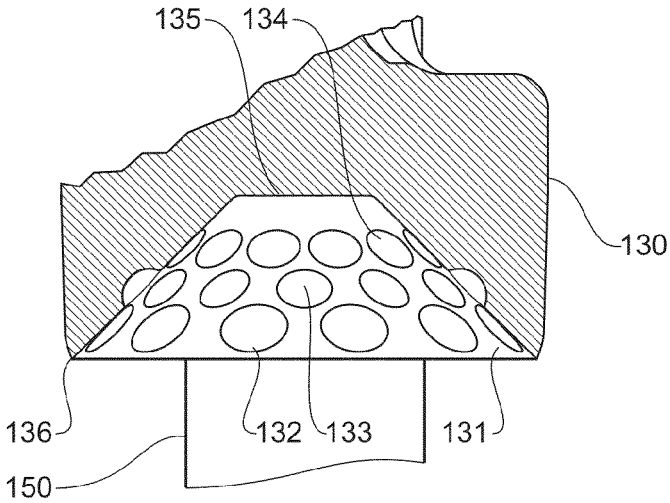

FIG. 5 is a detailed view of the spray head incorporating the spray plate.

In the following description, like reference characters designate like or corresponding parts throughout the several views of the drawings.

DESCRIPTION OF ILLUSTRATIVE EMBODIMENT

Figure 1:
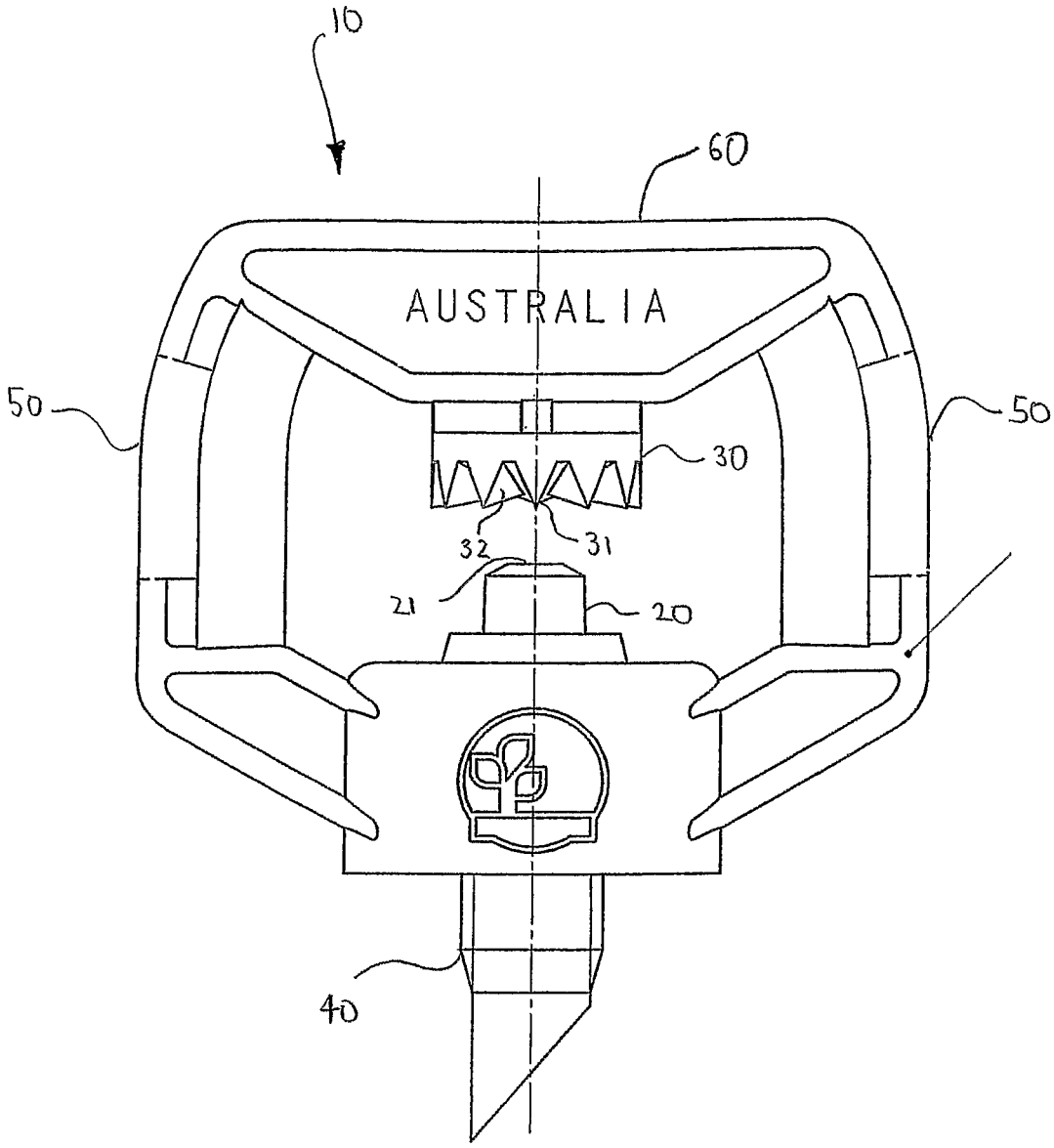
FIGURE 1 (Prior Art)
FIG. 1 is a front elevational view of a prior art spray device.
Figure 3:
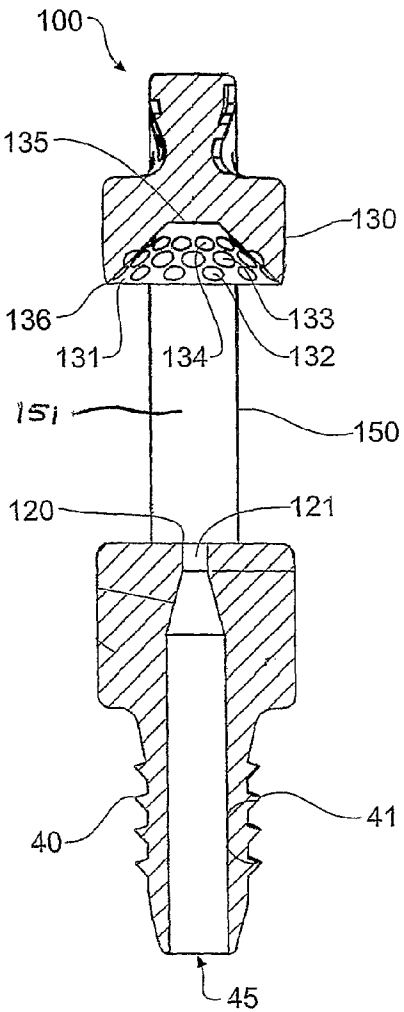
FIG. 3 is a side sectional view of the spray device illustrated in FIG. 1 through section 3-3.
Figure 2:
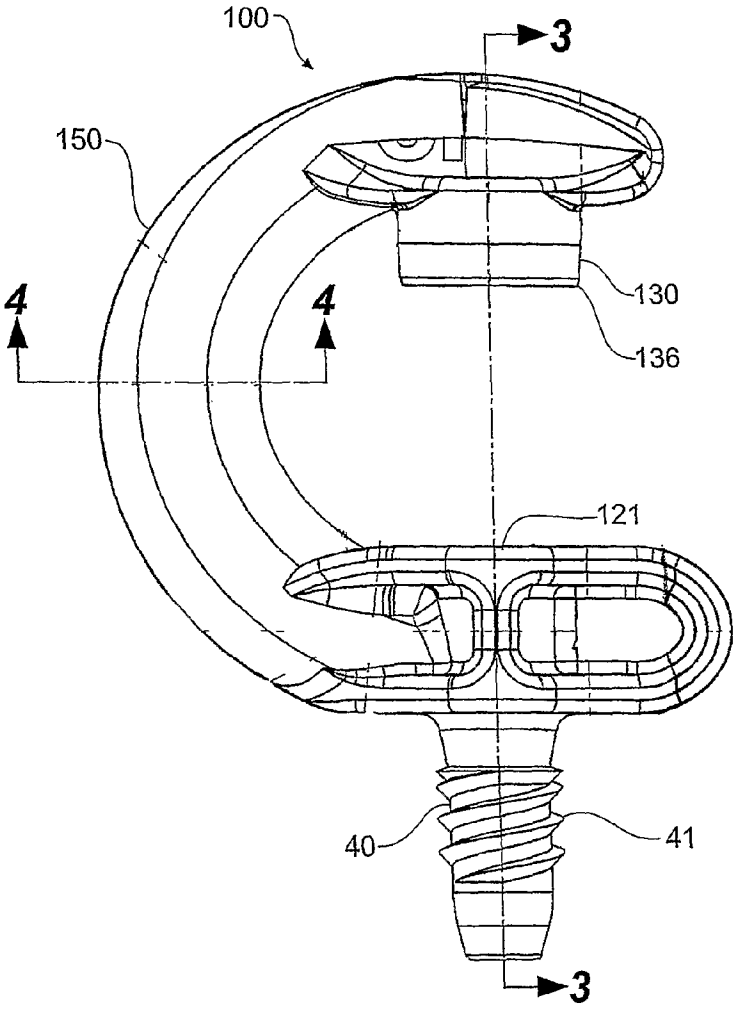
FIG. 2 is a front elevational view of a spray device according to an illustrative embodiment of the present invention.

Referring now to FIGS. 2 to 5, there are shown varying views of a spray device 100 according to an illustrative embodiment of the present invention. Spray device 100 includes a C-shape frame member 150 which functions as a support frame to support spray plate 130 directly above water outlet 120 having a central aperture 121. Water enters spray device through a central bore 45 located in insert 40 (as best seen in FIG. 2) which includes a screw threaded region 41 for the tapping of spray device 100 into an irrigation hose or the like. In this illustrative embodiment, spray device 100 is formed as moulded plastic unitary item but equally it may be formed from a number of separate components or other materials as desired.

In this embodiment, spray plate 130 includes a downwardly facing substantially cone shaped surface 131 which defines an included angle of 90°, and is formed as a recess within spray plate 130. In this illustrative embodiment, the vertex region of the cone shaped surface is flattened to provide a substantially horizontal face 135 at the closed end of the cone shaped surface 131. In another illustrative embodiment this vertex region may be radiused to form a rounded closed end.

The use of the cone-shaped surface 131 is ideal for watering circular areas, but it should be appreciated that other shapes can be employed to produce spray patterns of different shapes, eg. a concave pyramid shape can be used to water square areas or corners. Cone shaped surface 131 includes, starting from the outer edge 136, a first outer ring of equally spaced depressions or dimples 132 located radially about the cone shaped surface 131, a second intermediate ring of equally spaced depressions or dimples 133 also located radially about a cone shaped surface and a third innermost ring of equally spaced depressions or dimples 134. As best seen in FIG. 4, the depressions 132, 133 and 134 are located on different diameter pitch circles with the depressions in any one ring being staggered with respect to the depressions in an adjacent ring. The depth of the depression will vary depending on the flow rate of the spray device.

Figure 4A:
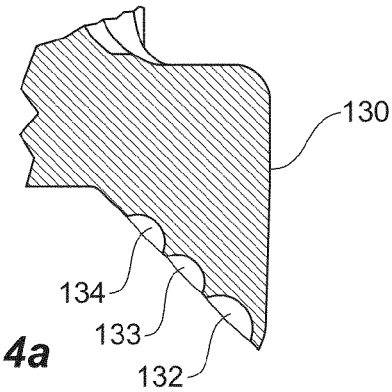

In this embodiment, the depressions are formed as hemispheres having a radius of either 0.5 or 0.6 mm, with the depressions in one row overlapping with a pair of depressions in an adjacent row in both circumferential and axial directions. Preferably, the size of the depressions in the inner and intermediate rows are smaller than those in the outermost rows as best shown in FIG. 4*a* resulting in the plurality of depressions being of varying size and/or depth. The overlapping of the depressions ensures that water flowing over the dispersion surface will always encounter a depression.

The depressions 132, 133 and 134 may be circular, elliptical or any non-regular shape. Additionally, depressions 132, 133 and 134 may have sharp or rounded edges depending on the requirements of the spray device 100. Whilst in this illustrative embodiment, each row of depressions 132, 133 and 134 has been arranged in a ring like configuration, equally they may be arranged randomly or according to another configuration over the cone shaped surface 131 for providing a substantially uniformly distributed spray pattern from spray plate 130.

In order to reduce frame shadow effects and minimise "run down" of water along the intermediate portion 151 of the frame 150, the frame 150 is C-shaped and the portion 151 is formed with an aerofoil shaped section. This substantially eliminates frame shadow effects that may produce non-uniformity in spray pattern, whilst maintaining the required strength of the frame and facilitating its manufacture by moulding.

In operation, water will enter spray device 100 from an irrigation hose via central bore 45 and exit from water outlet 120 defined by central aperture 121 having a substantially reduced diameter when compared with central bore 45. In this manner, water will exit water outlet 120 at velocity and impact with the horizontal end face 135 located at the inner end of spray plate 130. This will cause a substantial portion of the water to be deflected outwardly and to then flow as a sheet downwardly over the cone shaped surface 131 where it will interact with the concentric rings of depressions 132, 133 and 134. These function to deflect and break up what would be otherwise substantially uneven flow of the water along this cone shaped surface 131. In this manner, water does not simply flow along cone shaped surface 131 and exit at the outer peripheral edge 136, but is broken up causing a more evenly distributed flow across the surface 131 to produce a substantially uniformly distributed spray pattern from spray plate 130 which in turn provides a substantially evenly distributed, widespread spray over a designated area surrounding spray device 100.

As would be apparent to those skilled in the art, the present invention may be applied to many different spray device configurations and still remain within the scope of the invention. One example would include an arrangement where water is directed downwardly towards the spray plate. Another example would include an arrangement where a stream of water is caused to impact a spray plate having an outer cone shaped surface and water running along the outer face would be disturbed by the flow deflection means located on the outer surface, to thereby produce a uniformly spray pattern from the spray plate. Nor should the invention be limited to spray devices for use in irrigation as the invention will have application wherever a uniform distributed spray pattern is required such as in the spraying of paint and other liquids used in industrial processes.

A brief consideration of the above described embodiment will indicate that the invention provides an extremely simple, economical feature for a spray device which is effective to significantly improve the uniformity of the spray pattern produced by the device.

Although an illustrative embodiment of the present invention has been described in the foregoing detailed description, it will be understood that the invention is not limited to the embodiment disclosed, but is capable of numerous rearrangements, modifications and substitutions without departing from the scope of the invention as set forth and defined by the following claims.

The invention claimed is:

1. A spray device for spraying water over a designated area, said device including:

a spray plate including a central water impingement region and a water dispersion surface extending away from said central region and formed as a downwardly facing, substantially cone-shaped, recess in the spray plate, said central region having a center;

a liquid outlet to direct a stream of liquid from a pressurised source towards the central region of the spray plate to impinge there-against; and a support frame to maintain the spray plate in spaced apart relation to and in alignment with the liquid outlet, characterised in that the water dispersion surface includes flow deflection means to change the direction of flow of the water as it flows over the water dispersion surface to produce a substantially uniform spray pattern from the spray plate and thereby provide uniform water distribution over the designated area, wherein the flow deflection means includes a plurality of depressions formed in the water dispersion surface, the plurality of depressions being arranged in circular rows, each circular row having a pitch circle centred on a vertical central axis passing through the spray plate, the depressions in any one row being staggered with respect to the depressions in an adjacent row, the depressions being closed-bottom depressions positioned at different distances from the center of the spray plate, the depressions in each said row being equally spaced and overlap with adjacent depressions in an adjacent row in both circumferential and axial directions.

2. The spray device as claimed in claim 1, wherein the cone shaped surface has a flattened vertex region which forms said central water impingement region of the spray plate.

3. The spray device as claimed in claim 1, wherein the closed-bottom depressions are of a circular shape.

4. The spray device as claimed in claim 1, wherein the closed-bottom depressions are of an elliptical shape.

5. The spray device as claimed in claim 1, wherein the closed-bottom depressions are of a non-regular shape.

6. The spray device as claimed in claim 1, wherein the closed-bottom depressions have sharp edges.

7. The spray device as claimed in claim 1, wherein the support frame supports the spray plate directly above the liquid outlet.

8. The spray device as claimed in claim 1, wherein the spray device is formed as a moulded plastic unitary item.

9. The spray device as claimed in claim 1, wherein the downwardly facing substantially cone-shaped recess in the spray plate defines an included angle of 90°.

10. The spray device as claimed in claim 1, wherein the depth of the closed-bottom depressions is varied depending on the flow rate of the spray device.

11. A spray device for spraying water over a designated area, said device including:

a spray plate including a central water impingement region and a water dispersion surface extending away from said central region and formed as a downwardly facing, substantially cone-shaped, recess in the spray plate, said central region having a center;

a liquid outlet to direct a stream of liquid from a pressurised source towards the central region of the spray plate to impinge there-against; and a support frame to maintain the spray plate in spaced apart relation to and in alignment with the liquid outlet, characterised in that the water dispersion surface includes flow deflection means to change the direction of flow of the water as it flows over the water dispersion surface to produce a substantially uniform spray pattern from the spray plate and thereby provide uniform water distribution over the designated area, wherein the flow deflection means includes a plurality of depressions formed in the water dispersion surface, the plurality of depressions being arranged in three circular rows, each circular row having a pitch circle centred on a vertical central axis passing through the spray plate, the depressions in any one row being staggered with respect to the depressions in an adjacent row, the depressions being closed-bottom depressions positioned at different distances from the center of the spray plate, wherein the depressions in each row being approximately hemispherical and the depressions in the outer row being larger than those in each of the inner and intermediate rows.

12. The spray device as claimed in claim 11, wherein the support frame supports the spray plate directly above the liquid outlet.

13. The spray device as claimed in claim 11, wherein the spray device is formed as a moulded plastic unitary item.

14. The spray device as claimed in claim 11, wherein the downwardly facing substantially cone-shaped recess in the spray plate defines an included angle of 90°.

15. The spray device as claimed in claim 11, wherein the depth of the closed-bottom depressions is varied depending on the flow rate of the spray device.

16. The spray device as claimed in claim 11, wherein the cone shaped surface has a flattened vertex region which forms said central water impingement region of the spray plate.

* * * * *